US008250789B1

(12) United States Patent
Oliver

(10) Patent No.: US 8,250,789 B1
(45) Date of Patent: Aug. 28, 2012

(54) IRONING BOARD HAVING EXTENDABLE IRONING SURFACES

(76) Inventor: Steven Oliver, Hudson, FL (US)

( * ) Notice: Subject to any disclaimer, the term of this patent is extended or adjusted under 35 U.S.C. 154(b) by 230 days.

(21) Appl. No.: 12/621,545

(22) Filed: Nov. 19, 2009

(51) Int. Cl.
*D06F 81/12* (2006.01)
*D06F 81/00* (2006.01)

(52) U.S. Cl. ..... 38/135; 38/106

(58) Field of Classification Search ..... 108/115, 108/121, 63; 38/103–140
See application file for complete search history.

(56) References Cited

U.S. PATENT DOCUMENTS

| | | | | |
|---|---|---|---|---|
| 864,617 | A * | 8/1907 | Culbertson | 108/63 |
| 955,526 | A * | 4/1910 | Miller | 38/135 |
| 1,770,802 | A * | 7/1930 | Petty | 38/111 |
| 2,287,646 | A * | 6/1942 | Steele | 108/99 |
| 3,698,110 | A | 10/1972 | Shettel | |
| 4,910,896 | A | 3/1990 | Ruschitzka | |
| 5,016,367 | A | 5/1991 | Breen et al. | |
| 5,379,536 | A | 1/1995 | Lorenzana | |
| 5,572,811 | A * | 11/1996 | Lehrman | 38/106 |
| D434,541 | S | 11/2000 | Black | |
| 6,266,902 | B1 | 7/2001 | Dettwiler | |
| 6,286,237 | B1 * | 9/2001 | Toutounchian | 38/107 |
| 7,131,222 | B1 | 11/2006 | Glenn | |
| 7,243,447 | B1 | 7/2007 | Springer | |
| 2007/0209242 | A1 * | 9/2007 | Picco | 38/138 |

FOREIGN PATENT DOCUMENTS

JP 406198099 A * 7/1994

* cited by examiner

*Primary Examiner* — Ismael Izaguirre

(57) ABSTRACT

The ironing board having extendable ironing surfaces includes a traditional ironing board, a plurality of extendable ironing surfaces, a rear detachable basket, and a detachable leg basket. The plurality of extendable ironing surfaces attach to and rotate about a hinge that is also mounted to the undersurface of the main ironing surface. The rear detachable basket connects onto a clip mounted at the rear, underneath surface of the main ironing surface in order to prevent reduction in the surface area of the main ironing surface. The leg basket connects via attaching arms and rotates about one of the intersecting legs, and rests upon a second leg.

5 Claims, 5 Drawing Sheets

IRONING BOARD HAVING EXTENDABLE IRONING SURFACES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of ironing boards, more specifically, an ironing board that has extendable ironing surfaces with or without detachable baskets.

B. Discussion of the Prior Art

As a preliminary note, it should be stated that there is an ample amount of prior art that deals with ironing boards. As will be discussed immediately below, no prior art discloses an ironing board that has extendable ironing surfaces.

The Shettel Patent (U.S. Pat. No. 3,698,110) discloses an ironing board having an integral swingable arm position. However, the swingable arm is integrated into the top surface and does not swing out from underneath the top ironing surface.

The Dettwiler Patent (U.S. Pat. No. 6,266,902) discloses an ironing board having at least one pull-out sleeve board. Again, the pull-out sleeve board is not rotatably attached to the undersurface of the main ironing board and capable of extending and retracting there from.

The Breen et al. Patent (U.S. Pat. No. 5,016,367) discloses an ironing board having swingable extensions and a detachable suspended table for ironing trousers, shirts, and large items. However, the swingable extensions are at the same height as the main ironing surface and do not extend and retract from below the main ironing surface.

The Picco Patent Application Publication (U.S. Pub. No. 2007/0209242) discloses an element for extending the ironing surface of a home ironing board. However, the ironing board of Picco does not have extendable arms.

The Ruschitzka Patent (U.S. Pat. No. 4,910,896) discloses an ironing board having flip-out attachments. However, the flip-out attachments are not integrated into the bottom surface of the main ironing surface such that the attachments may be extended and retracted there from.

The Springer Patent (U.S. Pat. No. 7,243,447) discloses an ironing board expansion platform. However, the expansion platform fits onto the frontal end of the ironing board and provides neither a sleeve-like ironing surface nor a surface that extends and retracts from beneath the main ironing surface.

The Lorenzana Patent (U.S. Pat. No. 5,379,536) discloses a basket for attachment to an ironing board. However, the attachment fits upon an end of the main ironing surface and minimizes the overall surface area of the main ironing surface as opposed to an attachment that attaches via a clip or bracket that mounts underneath said main ironing surface.

The Lackman Patent (U.S. Pat. No. 5,572,811) discloses an ironing board having a wire rack that spans across both support legs near where they intersect. However, the wire rack does not attach via a plurality of hooks wherein said rack can be simply removed by lifting the rack up from the intersecting legs.

The Glenn Patent (U.S. Pat. No. 7,131,222) discloses a combined ironing board and container support member. However, the container support member attaches about the intersecting legs in a manner not involving a plurality of hooks.

While the above-described devices fulfill their respective and particular objects and requirements, they do not describe an ironing board having extendable ironing surfaces and of which may further include a rear, detachable basket iron holder and a detachable basket that rests upon the intersecting legs of the ironing board. In this regard, the ironing board having extendable ironing surfaces departs from the conventional concepts and designs of the prior art.

SUMMARY OF THE INVENTION

The ironing board having extendable ironing surfaces includes a traditional ironing board, a plurality of extendable ironing surfaces, a rear detachable basket, and a detachable leg basket. The plurality of extendable ironing surfaces attach to and rotate about a hinge that is also mounted to the undersurface of the main ironing surface. The rear detachable basket connects onto a clip mounted at the rear, underneath surface of the main ironing surface in order to prevent reduction in the surface area of the main ironing surface. The leg basket connects via attaching arms and rotates about one of the intersecting legs, and rests upon a second leg.

An object of the invention is to provide an ironing board with extendable ironing surfaces that extend and retract from underneath the main ironing surface.

A further object of the invention is to provide an ironing board with multiple detachable baskets.

A further object of the invention is to provide an ironing board that has extendable ironing surfaces for use in ironing shirt sleeves.

A further object of the invention is to provide an ironing board that is easy-to-use, effective in ironing sleeves, effective in storing ironing needs, and affordable.

These together with additional objects, features and advantages of the ironing board having extendable ironing surfaces will be readily apparent to those of ordinary skill in the art upon reading the following detailed description of presently preferred, but nonetheless illustrative, embodiments of the ironing board having extendable ironing surfaces when taken in conjunction with the accompanying drawings.

In this respect, before explaining the current embodiments of the ironing board having extendable ironing surfaces in detail, it is to be understood that the ironing board having extendable ironing surfaces is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ironing board having extendable ironing surfaces.

It is therefore important that the claims be regarded as including such equivalent construction insofar as they do not depart from the spirit and scope of the ironing board having extendable ironing surfaces. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
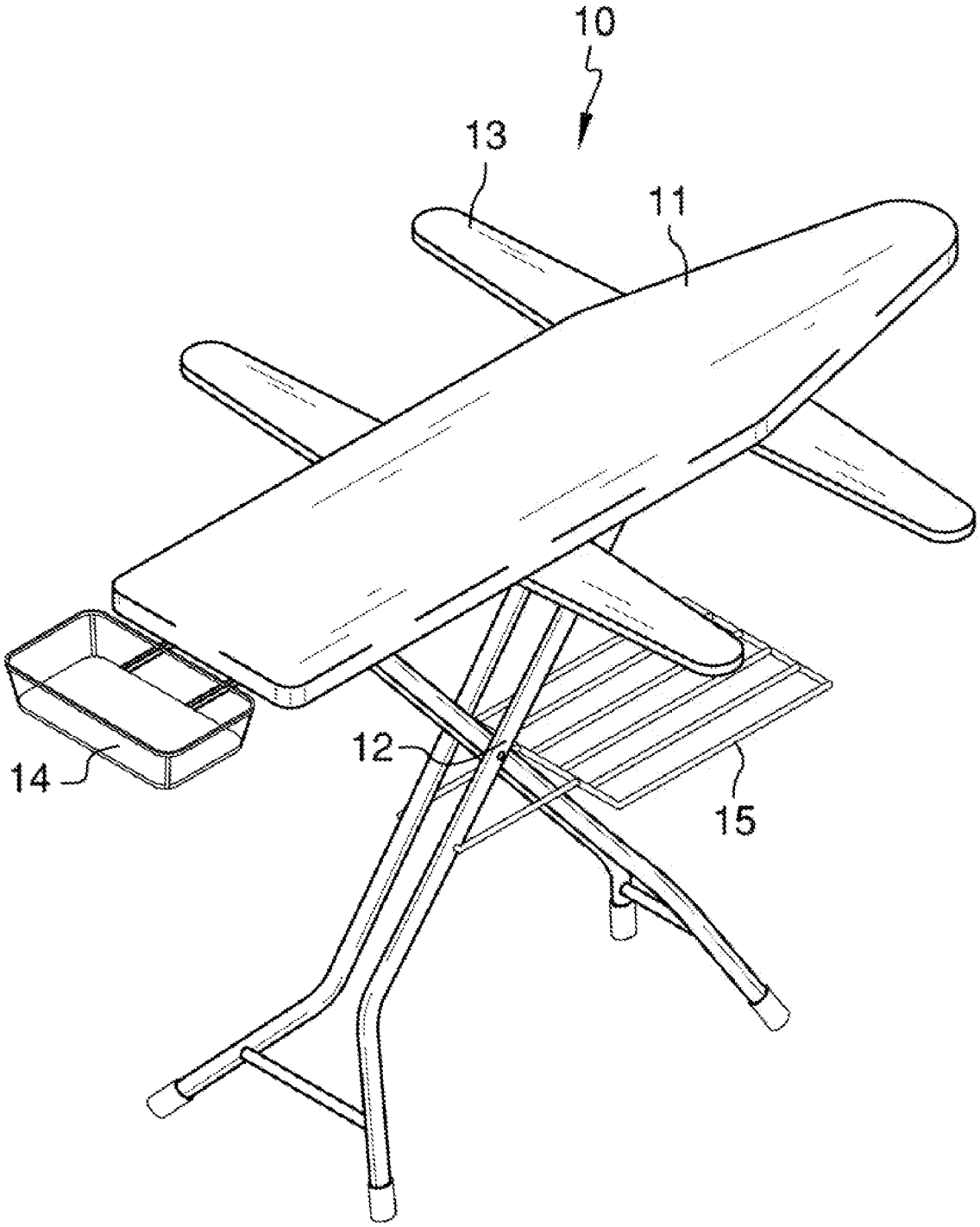
FIG. 1 illustrates an isometric view of the ironing board having extendable ironing surfaces extended and both rear basket and leg basket attached to the ironing board.
Figure 2:
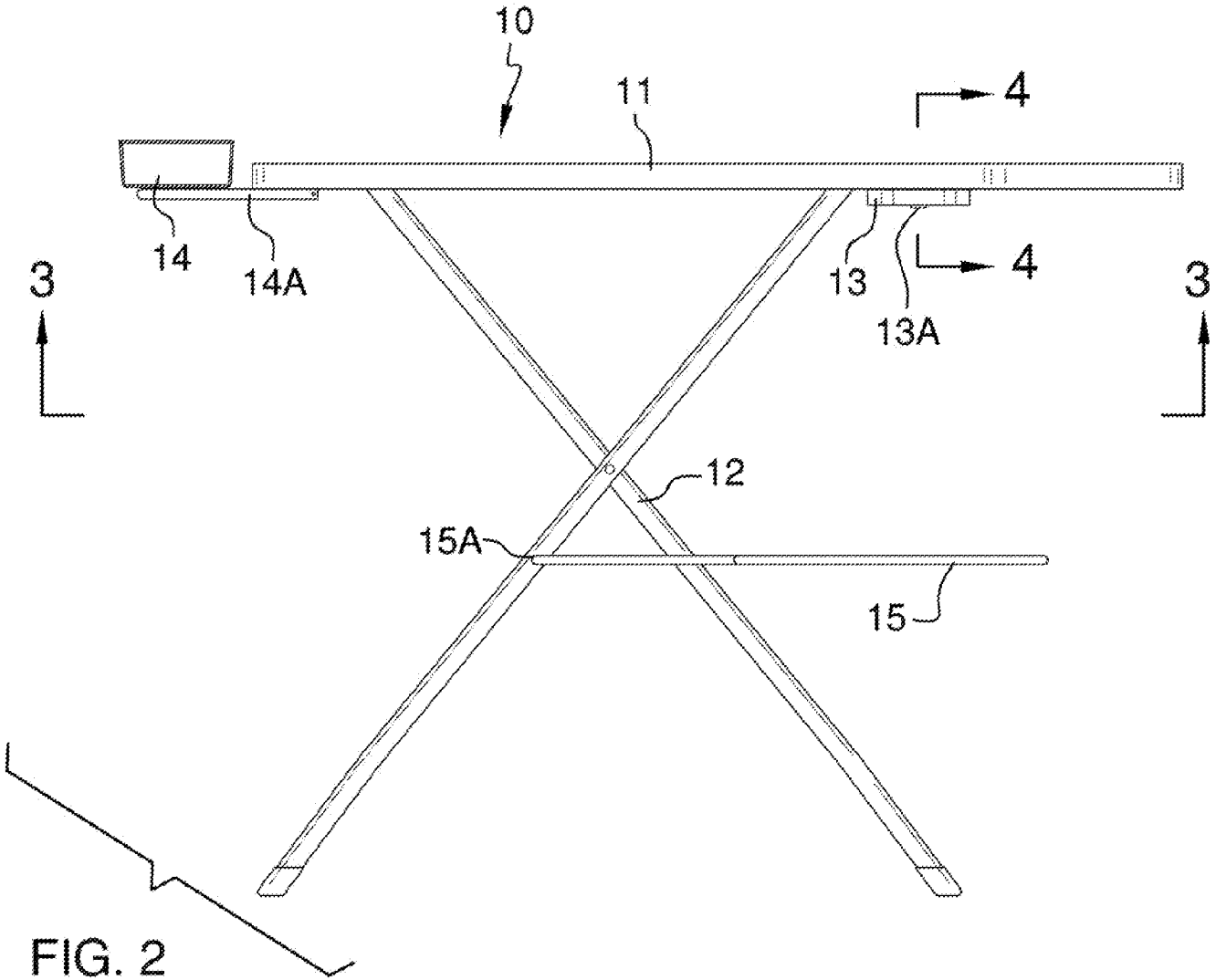
FIG. 2 illustrates a side view of the invention with arrows indicating removal of both the rear basket and the leg basket.
Figure 3:
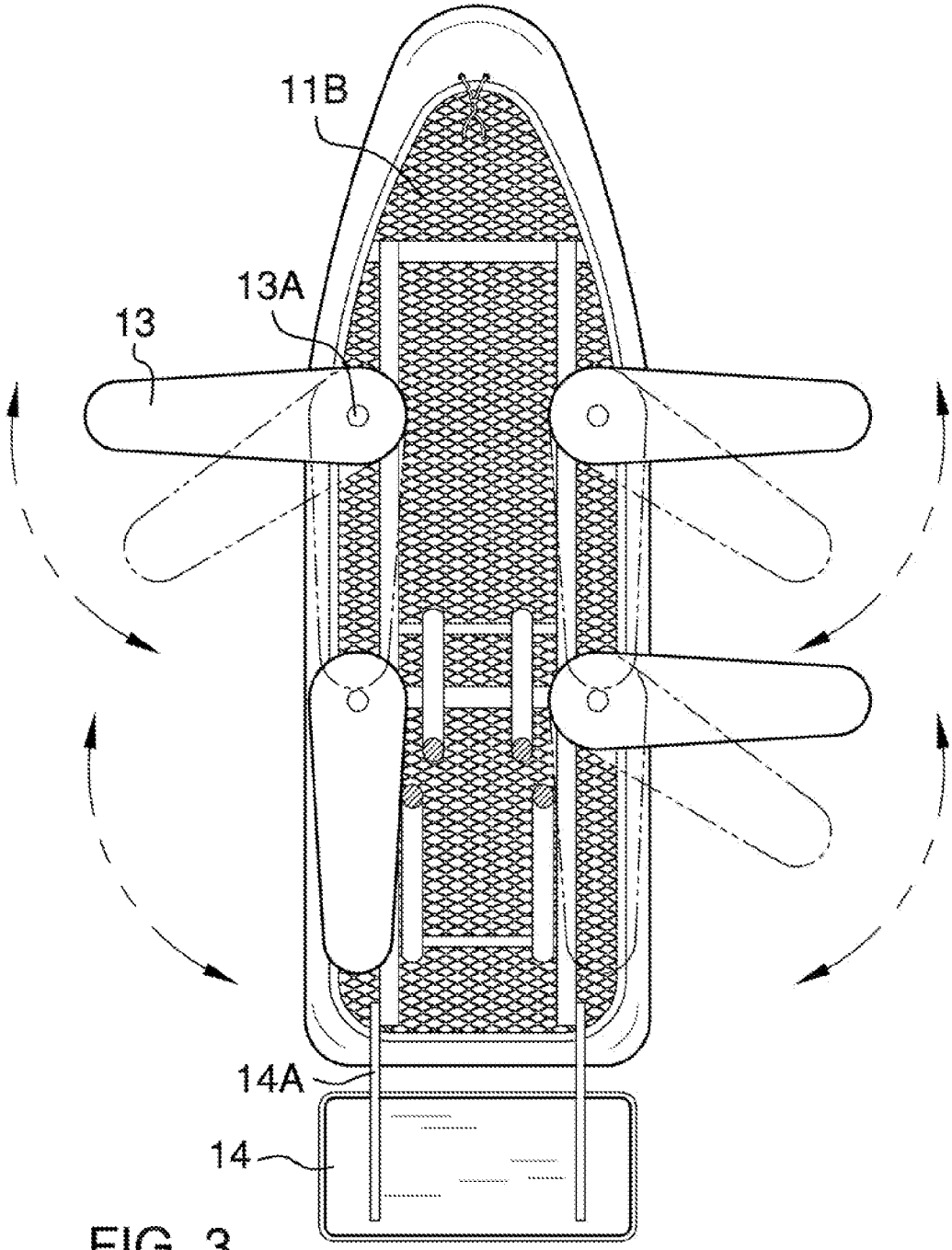
FIG. 3 illustrates a bottom view of the invention with the extendable ironing surface rotating about their respective hinge.
Figure 4:
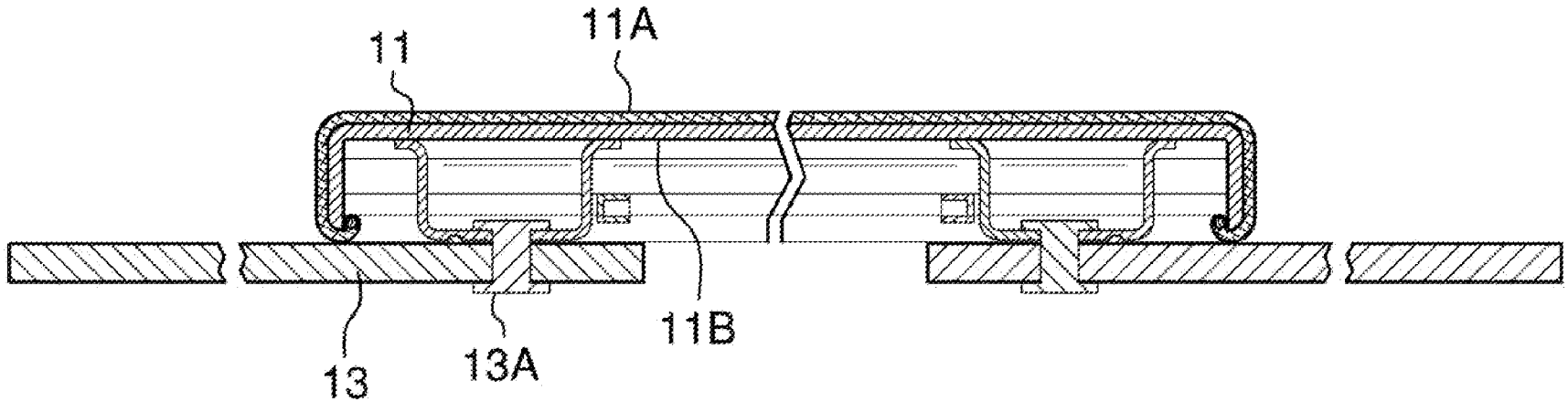
FIG. 4 illustrates a cross-sectional view of the invention along line 4-4 in FIG. 2.

Detailed reference will now be made to the preferred embodiment of the present invention, examples of which are illustrated in FIGS. 1-5. An ironing board having extendable ironing surfaces 10 (hereinafter invention) includes an ironing board 11, intersecting legs 12, a plurality of extendable ironing surfaces 13, rear basket 14, and leg basket 15.

The ironing board 11 and intersecting legs 12 operate like a traditional foldable ironing board. It shall be noted that the term for main ironing surface involves a top surface 11A of the ironing board 11. It shall be noted that the invention 10 may be adapted for use with an existing foldable ironing board or integrated into the design of a new ironing board.

Figure 5:
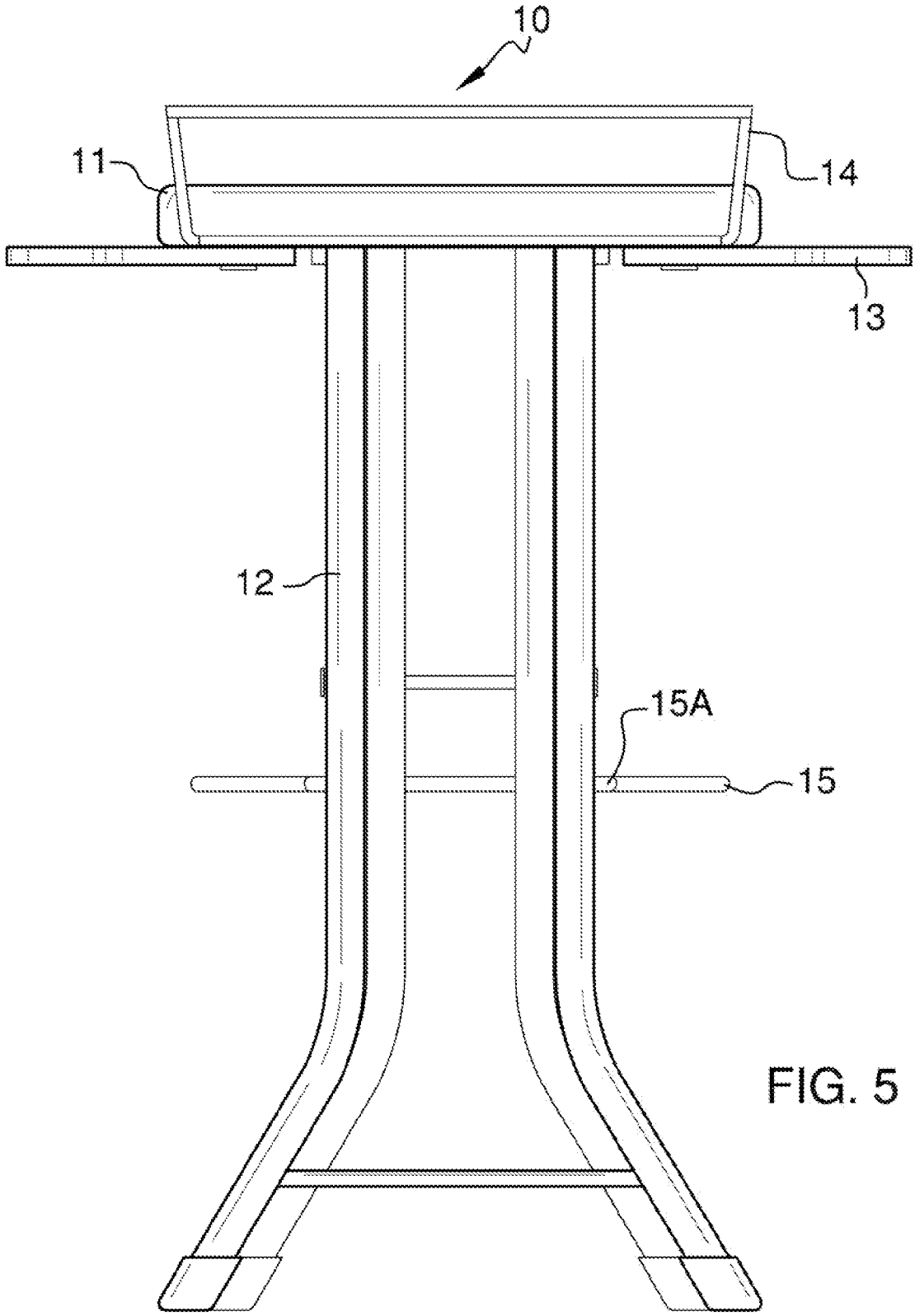
FIG. 5 illustrates a rear view of the invention.

The main feature of the invention 10 is the inclusion of the extendable ironing surfaces 13. The extendable ironing surfaces attach to a bottom surface 11B of the ironing board 11 via a hinge 13A. The hinge 13A enables the extendable ironing surfaces 13 to extend from and retract underneath the ironing board 11. Referring to FIG. 5, the extendable ironing surfaces 13 are generally parallel with the ironing board 11, but are at a different elevation with the ironing board 11 on account of the hinge 13A. It shall be noted that the extendable ironing surfaces 13, as depicted, illustrate a front and rear located ironing surfaces.

The rear basket 14 attaches to an end surface 11C of the ironing board 11 via a bracket 14A that mounts to the bottom surface 11B of the ironing board 11. The rear basket 14 provides a place to rest an iron and ironing supplies just off of the ironing board 11.

The leg basket 15 attaches to the intersecting legs 12 via attaching arms 15A that rotate about one leg, and of which a body of the leg basket 15 rests about a second leg. The leg basket 15 can rotate about the one leg, and can fold up flat with the intersecting legs 12. The leg basket 15 provides a surface from which ironing supplies may rest.

The ironing board 11, intersecting legs 12, extendable ironing surfaces 13, rear basket 14, and leg basket 15 are made of a material comprising a wood, metal, or durable plastic.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A ironing board having extendable ironing surfaces comprising:
- wherein the extendable ironing surfaces attach to a bottom surface of the ironing board;
- wherein the extendable ironing surfaces extend and retract from underneath the ironing board via a hinge;
- wherein each extendable ironing surface is generally parallel with and located under the ironing board;
- wherein each extendable ironing surface is unseen from above when underneath the ironing board, and can rotate out from underneath the ironing board in order to provide an additional surface for ironing, and said extendable ironing surface can subsequently rotate back underneath said ironing board;
- wherein the extendable ironing surfaces do not obstruct use of said ironing board when extended or fully retracted;
- wherein said ironing board includes intersection legs that extend down and support said ironing board for use;
- wherein a leg basket attaches to the intersecting legs via attaching arms, which rotate about one leg, and of which a body of the leg basket rests about a second leg; and
  - wherein the leg basket can rotate about the one leg, and can fold up flat with the intersecting legs.

2. The ironing board as described in claim 1 wherein a rear basket is attached to the ironing board via a bracket that attaches to the bottom surface of the ironing board and of which prevents obstruction of the ironing surface of the ironing board.

3. The ironing board as described in claim 1 wherein the extendable ironing surfaces and the ironing board are made of a material consisting of a metal, wood, or plastic.

4. A ironing board having extendable ironing surfaces comprising:
- wherein the extendable ironing surfaces attach to a bottom surface of the ironing board;
- wherein the extendable ironing surfaces extend and retract from underneath the ironing board via a hinge;
- wherein each extendable ironing surface is generally parallel with and located under the ironing board;
- wherein each extendable ironing surface is unseen from above when underneath the ironing board, and can rotate out from underneath the ironing board in order to provide an additional surface for ironing, and said extendable ironing surface can subsequently rotate back underneath said ironing board;
- wherein the extendable ironing surfaces do not obstruct use of said ironing board when extended or fully retracted;
- wherein said ironing board includes intersection legs that extend down and support said ironing board for use;
- (a) a rear basket;
  - wherein the rear basket is attached to the ironing board via a bracket that attaches to the bottom surface of the ironing board and of which prevents obstruction of the ironing surface of the ironing board;
- (b) a leg basket;
  - wherein the leg basket attaches to intersecting legs of the ironing board via a plurality of hooks that attach to the intersecting legs below the point of intersection of the intersecting legs.

5. The ironing board as described in claim 4 wherein the extendable ironing surfaces, the ironing board, the rear basket, and the leg basket are made of a material consisting of a metal, wood, or plastic.

* * * * *